US006913506B2

(12) United States Patent
Tiefel et al.

(10) Patent No.: US 6,913,506 B2
(45) **Date of Patent: *Jul. 5, 2005**

(54) ELECTRIC TOY TOP DEVICE WITH SUPPORT AND ITS ASSOCIATED METHOD OF OPERATION

(76) Inventors: Simeon E. Tiefel, 5852 NE. 197th St., Kenmore, WA (US) 98028; Webb T. Nelson, 19180 144th Ave. NE., Woodinville, WA (US) 98072

( * ) Notice: Subject to any disclaimer, the term of this patent is extended or adjusted under 35 U.S.C. 154(b) by 0 days.

This patent is subject to a terminal disclaimer.

(21) Appl. No.: 10/874,404

(22) Filed: Jun. 22, 2004

(65) Prior Publication Data

US 2004/0253907 A1 Dec. 16, 2004

Related U.S. Application Data

(63) Continuation-in-part of application No. 10/417,601, filed on Apr. 18, 2003, now Pat. No. 6,773,328, which is a continuation-in-part of application No. 10/243,813, filed on Sep. 16, 2002, now Pat. No. 6,685,531.

(51) Int. Cl.[7] ..... A63H 1/00
(52) U.S. Cl. ..... 446/236; 446/256; 273/147
(58) Field of Search ..... 446/233, 236, 446/256, 264, 266, 131, 132, 238, 260, 262, 263; 273/147, 109, 108, 112

(56) References Cited

U.S. PATENT DOCUMENTS

| | | | | | |
|---|---|---|---|---|---|
| 3,224,142 | A | * | 12/1965 | Pawelka et al. | 446/138 |
| 3,335,519 | A | * | 8/1967 | Elward | 446/264 |
| 3,533,187 | A | * | 10/1970 | Campbell | 446/233 |
| 3,628,285 | A | * | 12/1971 | Murakami | 446/233 |
| 4,200,283 | A | * | 4/1980 | Andrews et al. | 273/108 |
| 5,683,284 | A | * | 11/1997 | Christen | 446/233 |
| 6,419,544 | B1 | * | 7/2002 | Parker et al. | 446/233 |

* cited by examiner

*Primary Examiner*—Derris H. Banks
*Assistant Examiner*—J Williams
(74) *Attorney, Agent, or Firm*—LaMorte & Associates

(57) ABSTRACT

A system comprising a rotating device and a support structure for the rotating device, wherein the support structure provides the power to the rotational device that is required to maintain spin. The rotating device has a housing with a base upon which the housing spins. An electric motor is contained within the housing that causes the housing to spin when the motor is activated. The base of the rotating device can be selectively placed on a support structure. The support structure can promote spinning in the rotating device in one of two ways. In the first way, the support structure provides electricity to the rotating device that powers the motor in the rotating device. In the second way, the support structure can generate a magnetic field that biases the rotating device against the charging port on the support platform.

12 Claims, 2 Drawing Sheets

ELECTRIC TOY TOP DEVICE WITH SUPPORT AND ITS ASSOCIATED METHOD OF OPERATION

RELATED APPLICATIONS

This application is a continuation-in-part of U.S. Pat. No. 10/417,601, filed Apr. 18, 2003, and entitled Electric Toy Top Device With Finger Supported Charger And Its Associated Method Of Operation, now U.S. Pat. No. 6,773,328 which is a continuation-in-part of U.S. patent application Ser. No. 10/243,813 filed Sep. 16, 2002, entitled Electric Toy Top Device With Support And Its Associated Method Of Operation, now U.S. Pat. No. 6,685,531.

BACKGROUND OF THE INVENTION

1. Field of the Invention

Generally, the present invention relates to toy tops, gyroscopes and other rotating novelty devices. More particularly, the present invention relates to rotating novelty devices that contain internal electric motors that are periodically powered by a separate electric source that is remote to the rotating novelty device.

2. Description of the Prior Art

Tops, gyroscopes and other freely rotating devices share certain common functional features. Tops, gyroscopes and other rotating devices have a central axis around which they spin. The center of gravity associated with the rotating device passes through that central axis and the mass of the rotating device is evenly distributed around the central axis. As the top, gyroscope or similar device is put into motion, the device spins about its central axis. Since the mass of the rotating device is evenly distributed around the central axis, the device spins in a uniform manner, thereby enabling the device to be balanced at a point in line with the central axis. The device will spin in a stable manner until the rotational speed of the device falls below a certain threshold level. As the speed of the device decreases, its angular momentum decreases. Eventually, the presence of angular momentum is insufficient to overcome the forces of gravity and the rotating device tips over.

Tops, gyroscopes and other rotating novelty devices have been in existence for generations. During that period of time, there have been many variations in design of the rotating novelty devices. In their simplest form, rotating novelty devices, such as tops and gyroscopes, are either directly manually spun or manually spun using a pull cord that is wound around the rotating novelty device. Such manual means to provide rotational energy are inexpensive, however the rotational energy provided is relatively small. Consequently, the top or gyroscope would only rotate for a short period of time before they tip over.

The longer a top, gyroscope or other freely rotating device spins, the more play value it generally has. Consequently, in the prior art, attempts have been made to create tops, gyroscopes and other freely rotating devices that spin for extended periods of time. One popular method of creating a device that spins for a prolonged period of time is to place a motor within the structure of the device. The motor spins a weight, thereby producing the angular momentum needed to maintain a spinning motion for as long as the motor is powered.

In the prior art, such devices are typically created by placing an electric motor in the center of the top or other freely rotating device. Batteries are then symmetrically placed around the electric motor so as to be balanced around the center of rotation. The batteries typically serve as the majority of the weight that is spun. As a result, the batteries both provide power to the electric motor and add significantly to the angular momentum of the device. Such prior art devices are exemplified by U.S. Pat. No. 3,628,285, to Murakami, entitled Gyroscopic Top Device.

A problem associated with prior art tops and gyroscopes that contain internal motors and batteries is that great care must be taken in the manufacturing tolerances in order to maintain the proper balance. This raises the cost associated with manufacturing such devices. Furthermore, since the spinning object contains both an electric motor and batteries, the device is rather heavy. Such devices, therefore, have a tendency to become damaged if the commonplace happens and the device falls to the floor after spinning off a table edge or falls out of a child's hand.

A need therefore exists for an improved type of drive system for a spinning top, gyroscope or other freely rotating device that provides rotational energy to the device, yet does not require that batteries be contained within the rotating device. This need is met by the present invention as described and claimed below.

SUMMARY OF THE INVENTION

The present invention is a system comprising a rotating device and a support structure for the rotating device, wherein the support structure provides the power to the rotational device that is required to maintain spin. The rotating device has a housing with a base upon which the housing spins. An electric motor is contained within the housing that causes the housing to spin when the motor is activated. The base of the rotating device can be selectively placed on a support structure. The support structure can promote spinning in the rotating device in one of two ways. In the first way, the support structure provides electricity to the rotating device that powers the motor in the rotating device. In the second way, the support structure can generate a magnetic field that biases the top against a charging position on the support structure, thereby causing the motor to spin faster than it would outside the effects of that magnetic field.

BRIEF DESCRIPTION OF THE DRAWINGS

For a better understanding of the present invention, reference is made to the following description f an exemplary embodiment thereof, considered in conjunction with the accompanying drawings, in which.

DETAILED DESCRIPTION OF THE INVENTION

Although the present invention device can be configured in many shapes and styles, such as a gyroscope or freely rotating toy, the present invention device is particularly well suited as a top. Accordingly, the illustrated example of the present invention device will be configured as a top in order to set forth the best mode contemplated for the invention. However, the choice of embodying the present invention in a top should not be considered a limitation of the possible applications of the present invention device.

Figure 1:
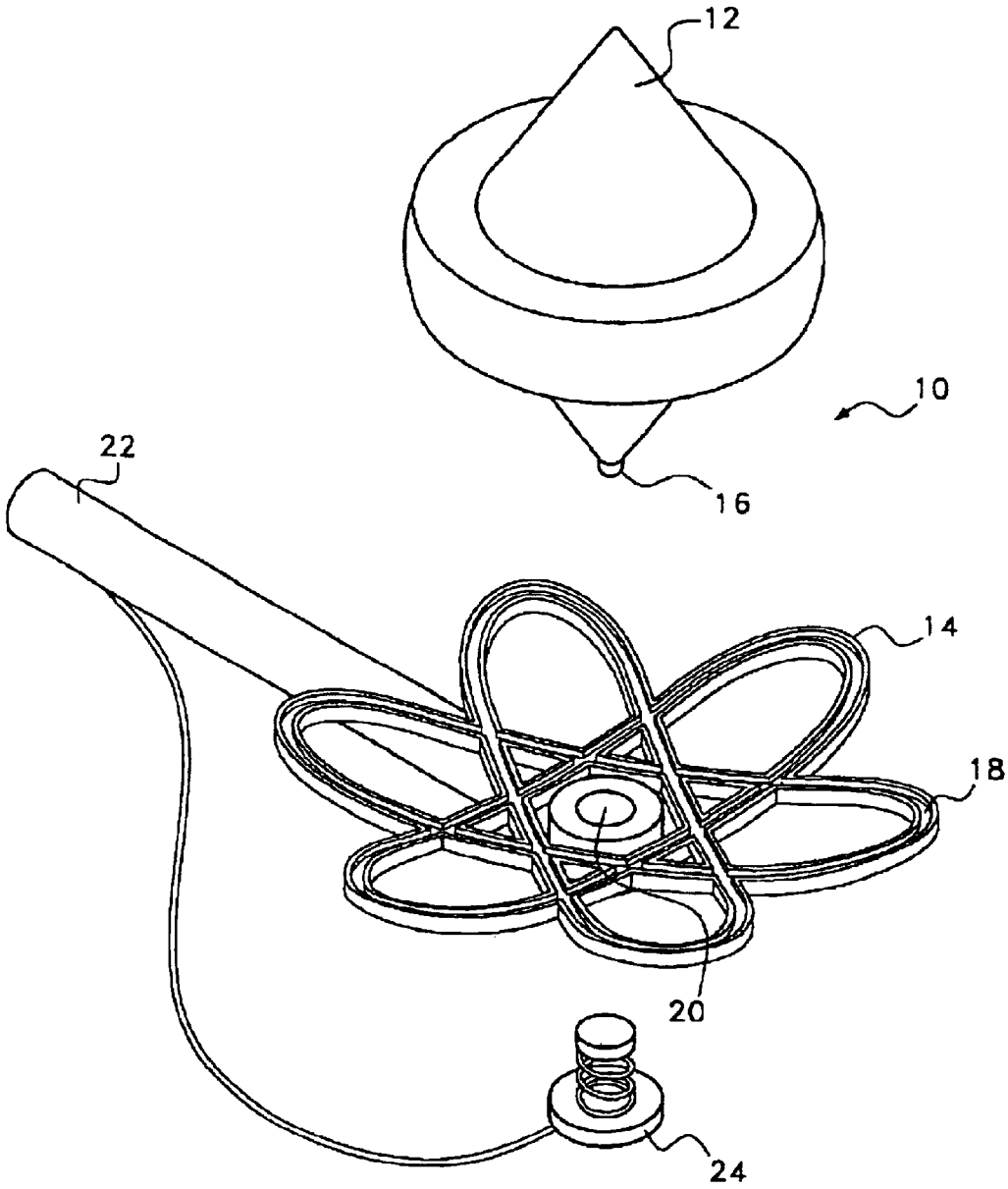
FIG. 1 is a perspective view of an exemplary embodiment of a system in accordance with the present invention.

Referring to FIG. 1, a toy top system 10 is shown. The toy top system 10 is comprised of a top 12 and a support structure 14 for the top 12. The top 12 has a balance point 16 upon which it rests as it spins. The support structure 14 includes a grooved pathway 18 that extends through a geometric pattern. The grooved pathway 18 is sized to receive the balance point 16 of the top 12. Consequently, as the top 12 spins, it can travel throughout the grooved pathway 18.

A charging port is disposed in the center of the geometric pattern of the grooved pathway 18. The grooved pathway 18 is gradually sloped toward the charging port 20. Accordingly, as the top loses angular momentum, gravity will cause the top 12 to have the tendency to settle in the charging port 20.

As will be explained, the top 12 contains an internal electric motor. The internal electric motor causes the top 12 to spin. The internal electric motor is powered only when the balance point 16 of the top 12 settles into the charging port 20. As a result, when the balance point 16 of the top 12 passes into the charging port 20, the internal electric motor increases and the rotational velocity of the top 12 increases. Once up to its maximum speed, the top 12 can again be directed through the grooved pathway 18.

The support structure 14 also includes a handle 22 that extends from the grooved pathway 18. By manipulating the handle 22, the orientation of the grooved pathway 18 can be changed and the spinning top 12 can be caused to move throughout the grooved pathway 18 or into the charging port 20.

The movement of the top 12 is not limited to the confines of the grooved pathway 18. Rather, the top 12 can be flipped out of the support structure 14 onto any smooth surface. As the top 12 eventually slows, the support structure 14 can be used to scoop up the spinning top 12. The top 12 can then be manipulated into the charging port 20, where it will again increase to its maximum rotational speed.

The support structure 14 also includes a magnetic assembly 24 that is tethered to the handle 22. The magnetic assembly 24 can be selectively positioned below the charging port 20. The magnetic assembly 24, when placed below the charging port 20, creates a magnetic field that extends above the charging port 20 and effects the top 12 when it settles into the charging port 20. The magnetic field created by the magnetic assembly 24 draws the top 12 against the charging port 20 with a force that compliments the force of gravity on the top 12. The top 12 therefore makes better electrical contact with the charging port 20. The result is that the electric motor in the top 12 will increase in rotational speed by up to two times when the magnetic assembly 24 is placed below the charging port 20.

Figure 2:
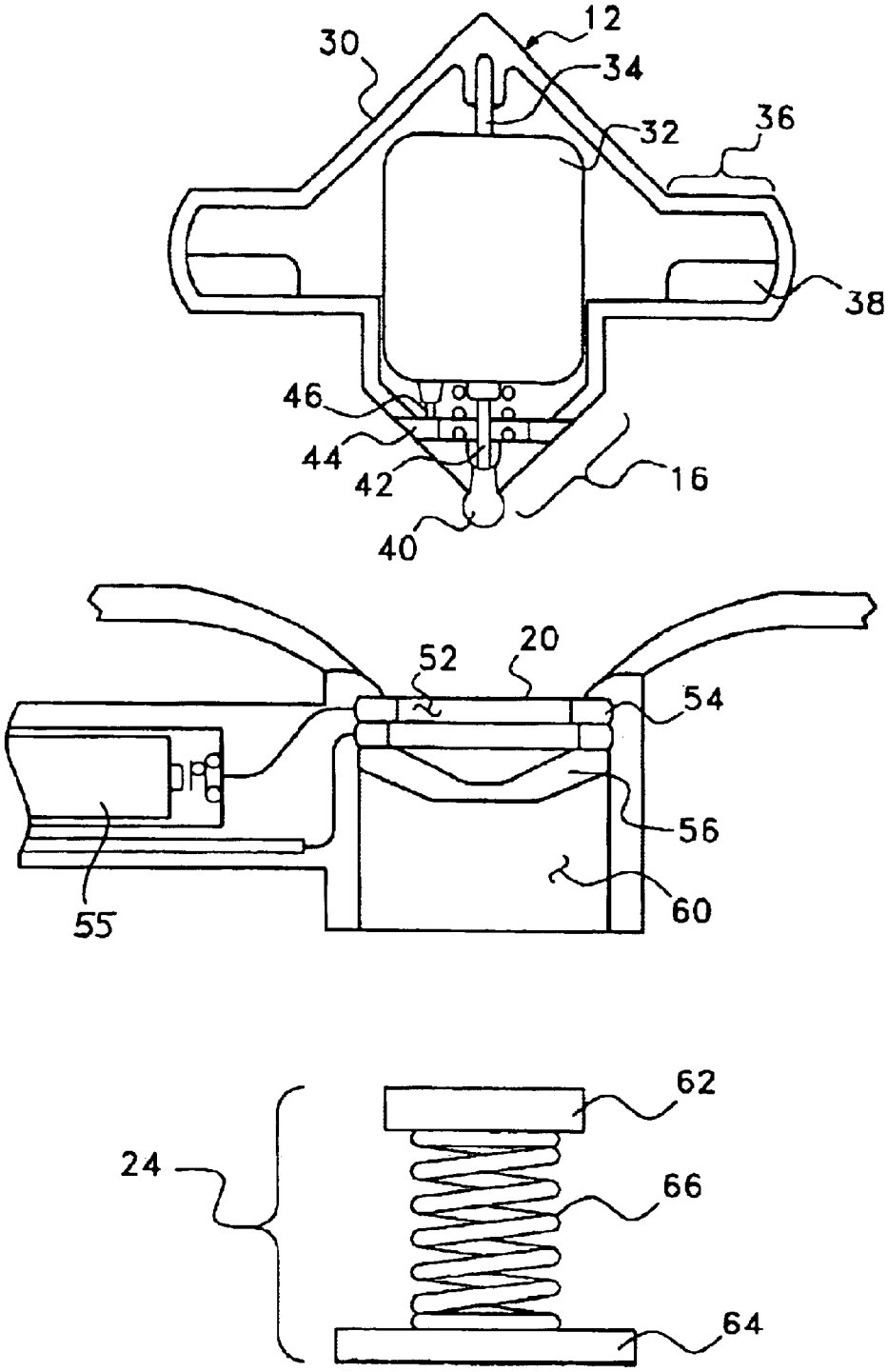
FIG. 2 is a selective cross-sectional view of the components of the system shown in FIG. 1.

Referring to FIG. 2, it can be seen that the top 12 is comprised of a housing 30 that defines a central chamber. Within the central chamber is a free floating electric motor 32. Only the output shaft 34 of the electric motor 32 is rigidly connected to the housing 30. Accordingly, the electric motor 32 can remain stationary as its output shaft 34 rotates the top's housing 30 around the motor 32.

The housing 30 has an outer ring section 36. Within the outer ring section 36 is a weighted flywheel 38. The flywheel 38 adds to the mass of the top 12 and provides the angular momentum needed to keep the top 12 stable as the top 12 spins.

The bottom of the top's housing 30 forms the balance point 16 of the top 12. At the apex of the balance point 16 is a conductive point contact 40 that is coupled to a first lead 42 of the electric motor 32. Slightly farther up from the apex is a conductive ring contact 44. The ring contact 44 leads to a wiping contact 46 that interconnects the ring contact 44 to a second lead of the electric motor 32.

The charging port 20 is an assembly of various components. The charging port 20 has a casing 50 that is connected to the handle 22 (FIG. 1) of the support structure 14. The casing 50 defines an annular opening 52 that is the top of the charging port 20. An annular contact 54 is disposed just below the top of the charging port 20. The annular contact 54 contacts the ring contact 44 on the top 12 when the balance point 16 of the top 12 passes into the charging port. The annular contact 54 is wired to a battery source 55 that is contained within the handle 22 (FIG. 1) of the support structure 14. Consequently, the annular contact 54 transfers electricity to the ring contact 44 in the top 12 when these surfaces abut.

A conductive cup 56 is located at the bottom of the charging port 20. The conductive cup 56 is isolated from the annular contact 54. The conductive cup 56 supports the weight of the top 12 when the top 12 is present in the charging port 20. As such, the conductive cup 56 comes into direct contact with the conductive point contact 40 at the apex of the balancing point 16. The conductive cup 56 is coupled to the oppositely charged leads of the batteries that are in the handle 22 (FIG. 1) of the support structure 14.

It will therefore be understood, that as the top 12 settles in the charging port 20, the two contacts on the bottom of the top 12 come into contact with the two contacts within the charging port 20. The contacts in the top 12 lead to the electric motor 32. The two contacts in the charging port 20 lead to opposite terminals of a battery source. As a result, when the top 12 is settled in the charging port 20, the electric motor 32 is powered and the top 12 will spin under the power of the electric motor 32.

A recessed opening 60 is located under the casing 50 of the charging port 20. The recessed opening 60 is sized to receive the magnetic assembly 24. The magnetic assembly 24 consists of a magnet 62, a base disc 64 and a spring 66 that couples the magnet 62 to the center of the base disc 64. When the magnet assembly 24 is inserted under the charging port 20, the magnet 62 magnetically engages the bottom surface of the conductive cup 56. This magnetic connection slightly stretches the spring 66 and biases the base disc 64 against the bottom of the casing 50.

As has been previously mentioned, when the electric motor 52 in the top 12 spins, it creates a magnetic field. Furthermore, the magnet 62 that is part of the magnetic assembly 24 also creates a magnetic field. When the magnetic assembly 24 is placed under the charging port 20 and the top 12 is in the charging port 20, the magnetic fields interact. The result is that the motor 32 is pulled against the charging port 20 and makes better electrical contact with the charging port 20. Thus, the motor 32 receives more current and spins significantly faster than it does when the magnetic assembly 24 is removed. Depending upon the strength of the magnet 62 used and the composition of the electric motor 32, the rotational speed imparted to the top 12 by the electric motor 32 can be increased by nearly 100% due to the presence of the magnetic assembly 24.

It will be understood that the embodiment of the present invention device that is described and illustrated herein is merely exemplary and a person skilled in the art can make many variations to the embodiment shown without departing from the scope of the present invention. All such variations, modifications and alternate embodiments are intended to be included within the scope of the present invention, as defined by the appended claims.

What is claimed is:

1. A system, comprising:

a rotating assembly having a point upon which said assembly can rotate;

an electric motor disposed within said assembly, wherein said electric motor rotates said rotating assembly upon said point when said electric motor is activated;

a support structure, containing an electrical power source and a charging port, wherein said electrical power source powers said electric motor in said rotating assembly when said point of said rotating assembly is received within said charging port; and a magnet disposed on said support structure that draws said rotating assembly against said charging port while said rotating assembly is spinning on said support structure.

2. The system according to claim 1, wherein said magnet is selectively positionable between a first position within said support structure and a second position.

3. The system according to claim 1, wherein said support structure contains a pathway through which said rotating assembly can travel when said rotating assembly is spinning.

4. The system according to claim 3, wherein said charging port is disposed along said pathway.

5. The system according to claim 3, wherein said pathway is symmetrically disposed around said charging port.

6. The system according to claim 3, wherein said support structure includes a handle for manually manipulating said pathway.

7. A method of operation for a toy top, said method including the steps of:

providing a top having an electric motor, wherein said electric motor causes said top to spin when activated;

providing support structure for supporting said top as it spins, wherein said support structure has contacts for transmitting electricity to said electric motor in said top as it spins on said support structure; and producing a magnetic field that draws said top against said support structure as said top spins on said support structure.

8. The method according to claim 7, wherein said step of producing a magnetic field includes providing a magnet within said support structure.

9. The method according to claim 7, further including the step of selectively eliminating said magnetic field from said support structure.

10. The method according to claim 7, wherein said step of providing a top includes providing a top with electrical contacts on an external surface that lead to said electric motor.

11. The method according to claim 10, wherein step of providing a support structure includes providing a structure containing an electrical power source that contacts said electrical contacts on said top and powers said electric motor when said top is in a predetermined charging position on said support structure.

12. The method according to claim 11 wherein said step of producing a magnetic field that draws said top against said support structure as said top spins on said support structure includes drawing said top against said support structure at said charging position.

* * * * *